United States Patent [19]

Rello

[11] 4,202,639

[45] May 13, 1980

[54] DAISY LOADING APPARATUS

[75] Inventor: Michael J. Rello, Willow Grove, Pa.

[73] Assignee: Exxon Research & Engineering Co., Florham Park, N.J.

[21] Appl. No.: 833,276

[22] Filed: Sep. 14, 1977

[51] Int. Cl.[2] ..... B41J 1/30

[52] U.S. Cl. ..... 400/171; 400/175; 400/144.2; 29/35.5; 414/225; 414/729

[58] Field of Search ..... 310/268; 214/1 BD, 147 T; 29/568; 400/144.2, 144.3, 174, 171, 175

[56] References Cited

U.S. PATENT DOCUMENTS

| | | | |
|---|---|---|---|
| 3,645,372 | 2/1972 | Noell et al. | 400/175 |
| 3,651,916 | 3/1972 | Becchi | 400/144.3 |
| 3,707,214 | 12/1972 | Ponzano | 400/144.2 |
| 3,795,324 | 3/1974 | Kiwalle | 214/1 BD |
| 3,848,722 | 11/1974 | Bolan et al. | 400/175 |
| 3,860,842 | 1/1975 | Schwab et al. | 310/268 |
| 3,892,303 | 7/1975 | Willcox | 400/171 |
| 3,904,015 | 9/1975 | Boyden et al. | 400/175 |
| 3,949,853 | 4/1976 | Lahr et al. | 400/144.3 |
| 4,026,403 | 5/1977 | Inose et al. | 400/144.2 |
| 4,088,217 | 5/1978 | Buckman | 400/175 |

OTHER PUBLICATIONS

Bransen "Character Wheel . . . Printer" IBM Technical Disclosure Bulletin vol. 16 No. 5 p. 1515 10/73.

*Primary Examiner*—William Pieprz

*Attorney, Agent, or Firm*—Norman L. Norris

[57] ABSTRACT

Disclosed is an assembly for mounting a daisy type character array within the air gap of a variable reluctance rotary stepping motor used to drive the daisy. The assembly comprises a guide means which accurately positions the daisy within the air gap. The daisy is supported in the air gap by means of a retractable support means. The invention further comprises a means for latching the support means within the air gap after the daisy has been mounted in order to provide rigidity to the daisy.

16 Claims, 14 Drawing Figures

DAISY LOADING APPARATUS

BACKGROUND OF THE INVENTION

This invention relates to serial impact printers and, more particularly, to serial impact printers employing rotatable character arrays such as a print wheel or daisy.

A print wheel of the daisy type, as shown in U.S. Pat. No. 3,949,853—Lahr et al, comprises a central hub portion which is removably coupled to the drive mechanism for the print wheel and a plurality of petals or radially-extending spokes which carry the various character elements at the radial extremities thereof in circumferentially spaced positions about the print wheel. Print wheels or daisies of this type may be utilized in a variety of applications. For example, print wheels may be used in serial printers such as those manufactured by Qume and Diablo, which are associated with communications terminals, computer output devices and other printing applications in the data processing field. In addition, such print wheels may be and are utilized in typewriters including equipment manufactured by Xerox Corp.

One important consideration in mounting a print wheel of the daisy-type is the manner in which the print wheel may be removed from the rotary drive mechanism. Removability and/or replacement of the print wheels is particularly important since the print wheels are subjected to a substantial battering force by the hammer. In addition, it is desirable, particularly in typewriter applications, to permit removability or replacement of the print wheel so as to allow for selection of a particular style of type by merely changing print wheels.

Replacement or removability of print wheels has been achieved in the Xerox typewriters which employ daisies by hinging the print wheel carriage so as to allow the print wheel and drive to be moved upwardly and away from the opposing platen. Once moved to this position, the print wheel may be extracted by pulling the print wheel from the end of the drive shaft since the platen is no longer in a position of interference with respect to that drive shaft. See also U.S. Pat. No. 3,707,214—Ponzano. Replacement of the daisy has also been achieved by hinging the printing hammer as shown in U.S. Pat. No. 3,651,916—Bacchi, so as to allow the daisy to be removed from the drive shaft.

In Ser. No. 809,923, filed June 24, 1977 by Dan W. Mathias and Richard E. Thornton, which is assigned to the assignee of the present invention, it is disclosed that it is desirable to form a daisy type character array as a unitary structure with the rotor of a high performance rotary stepper motor because such a structure reduces the mass of the combination character array and character array drive unit. This reduction in mass is advantageous in printers having a daisy or print wheel adapted to mount on a movable carriage because the smaller the overall mass of the carriage and its contents, the less energy is required to accelerate and decelerate it. In the daisy design disclosed by Mathias and Thornton, the combination character element/rotor element is mounted within the axial air gap situated between an excitable stator segment and a non-excitable stator segment. In the printer disclosed by Mathias and Thornton, the problem of removing and replacing the print wheel or daisy is aggravated due to the fact that the axial air gap is a very confined area. Accordingly, Mathias/-

Thornton disclosed a two-part shaft, the parts being adapted to mate end to end in axial alignment with one another to clamp the daisy character array therebetween. In mounting the character element using this arrangement, the daisy is first positioned within the air gap and a chamfered surface on the end of one of the two shaft parts axially guides the daisy into the proper position prior to its being clamped in place.

One problem associated with this arrangement has been that it is difficult for the operator of the printer to accurately center the daisy such that the chamfered surface may be an effective guide. Thus, it has been found that the daisy character element has been clamped to the shaft while not being properly aligned.

Another problem associated with this design has been that the two part shaft has not provided for sufficient rigidity of the daisy character element. Since the exact location of the daisy is critical to the printer's operation, a lack of rigidity of the shaft may make it difficult to maintain a fixed position of the character element which is fastened thereto.

A still further disadvantage has been that it has been difficult to remove the daisy after it has been positioned within the axial air gap since when the two part shaft has been separated, the daisy tends to fall through the air gap of the stepper motor to the bottom of the carriage.

It is an object of the present invention to provide a means for quickly mounting a daisy type character element to an impact printer.

It is a further object of the present invention to provide for ease in removability and replacement of a rotatable character array.

It is still a further object of the present invention to provide a means for mounting and locking a rotatable character array within the air gap of a rotary stepper motor.

It is a still further object of the present invention to provide a means for mounting and locking a rotatable character array in a fixed and unvarying position.

It is a still further object of the present invention to provide a means for quickly and easily dismounting a rotatable character array from an impact printer.

SUMMARY OF THE INVENTION

These and other objects of the present invention are accomplished by means of a movable guide means which accurately positions a circular rotatable character array within the axial air gap of a rotary stepper motor. The array is positioned between two axially aligned portions of a shaft. The invention further includes a means for clamping the character element between the portions of the shaft and within the air gap, and a locking means for preventing the character element from moving with respect to the clamping means. The present invention is characterized by the fact that the shaft upon which the character array is mounted is extremely rigid despite the fact that it is formed of two portions and thus, the character array is very accurately positioned with respect to the printer's hammer.

These and other objects of the present invention will be more fully understood by reference to the accompanying drawings in which.

DETAILED DESCRIPTION OF THE PREFERRED EMBODIMENT

Figure 1:
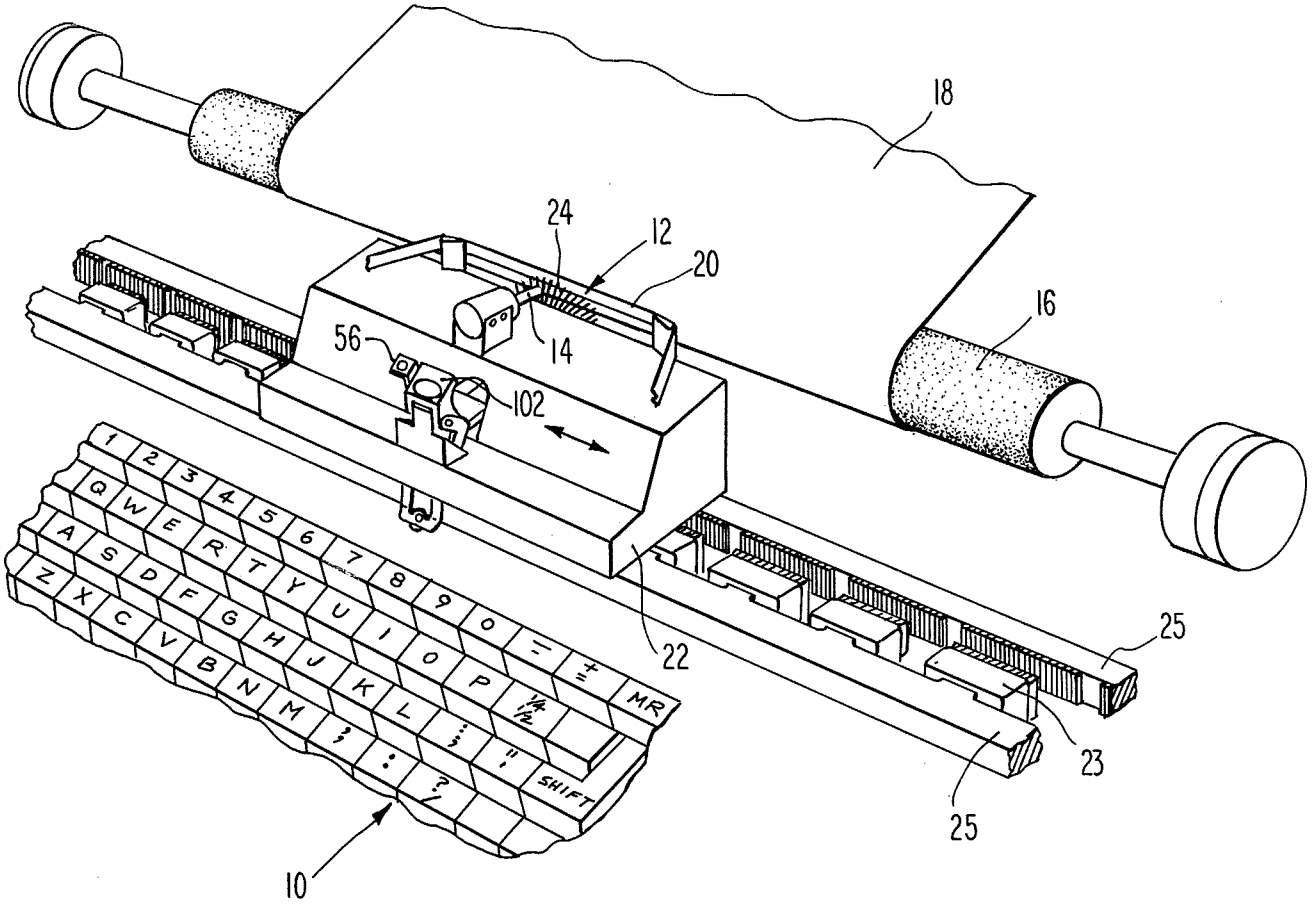
FIG. 1 is a perspective view of a printer having a daisy mounting assembly incorporating the present invention.

A typewriter shown in FIG. 1 comprises a keyboard 10 which includes a multiplicity of keys corresponding to various characters which, upon depression, control the position of a rotatable circular character array in the form of a print wheel or daisy 12 juxtaposed between impact means in the form of a hammer 14 and a platen 16. The platen 16 is adapted to support a print receiving medium in the form of paper 18 which is contacted by a marking medium in the form of a print ribbon 20 which is located between the print wheel 12 and the paper 18 so as to leave a mark in ink corresponding to the particular character of the print wheel which is in position between the hammer 14 and the paper 18.

As shown in FIG. 1, the print wheel 12 and the hammer 14 are mounted on a carriage 22 which is adapted to move in a direction parallel with the surface of the platen 16 so as to position the print wheel 12 at various positions along the paper 18 in response to the depression of keys on the keyboard 10. As the carriage 22 is moved, the print wheel 12 rotates so as to position the proper character element 27 which is located at the end of each radially extending spoke 24 in the printing position aligned with the print hammer 14. The linear movement of the carriage 22 along support surfaces 25 may be achieved by various means known in the art. However, as set forth in copending application Ser. No. 833,271 filed Sept. 14, 1977 (Attorney's Docket No. EX-L-4/Rm828) and assigned to the assignee of the present invention, the carriage 22 is preferably moved by means of a linear stepper motor 23.

Figure 2:
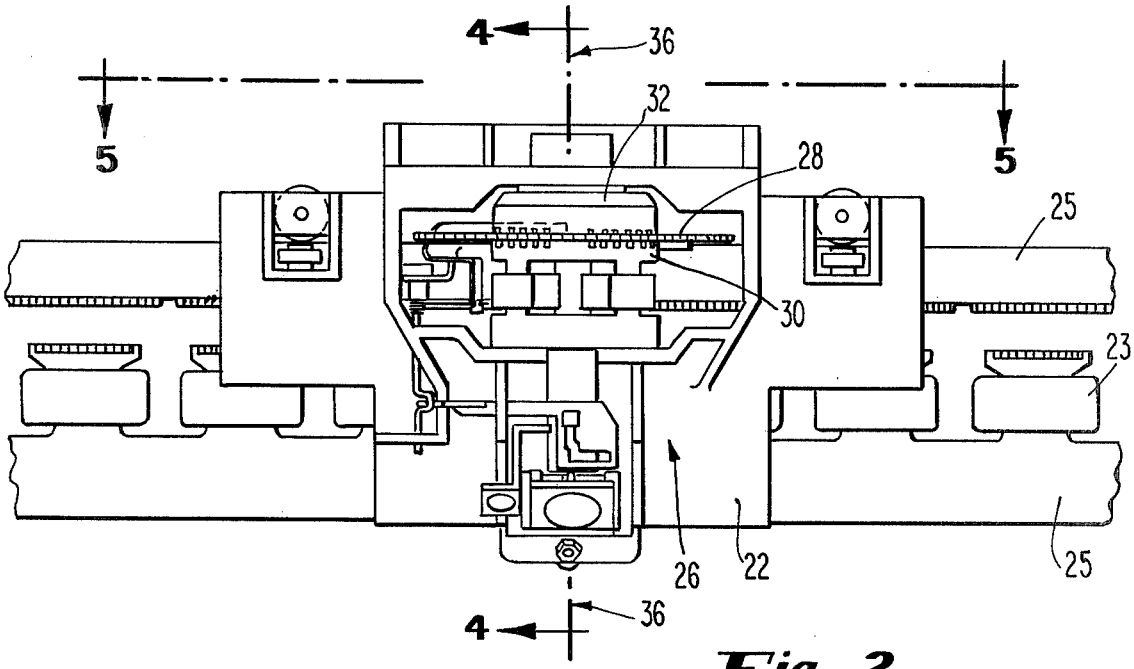
FIG. 2 is a top view of a portion of the printer shown in FIG. 1.

Reference will now be had to FIG. 2 wherein a top view of the carriage 22, after removal of its exterior housing, has been shown. Situated on the carriage 22 is a variable reluctance stepper motor 26 which comprises a stator comprising a first excited stator portion 30 and a second unexcited stator portion 32. The stator portions 30 and 32 are aligned on the axis 36 of the motor 26 and are separated from one another by an axial air gap. Situated within this air gap is a rotor 28, the rotary position of which is determined by the reluctance paths between the stator segments 30 and 32.

Figure 3:
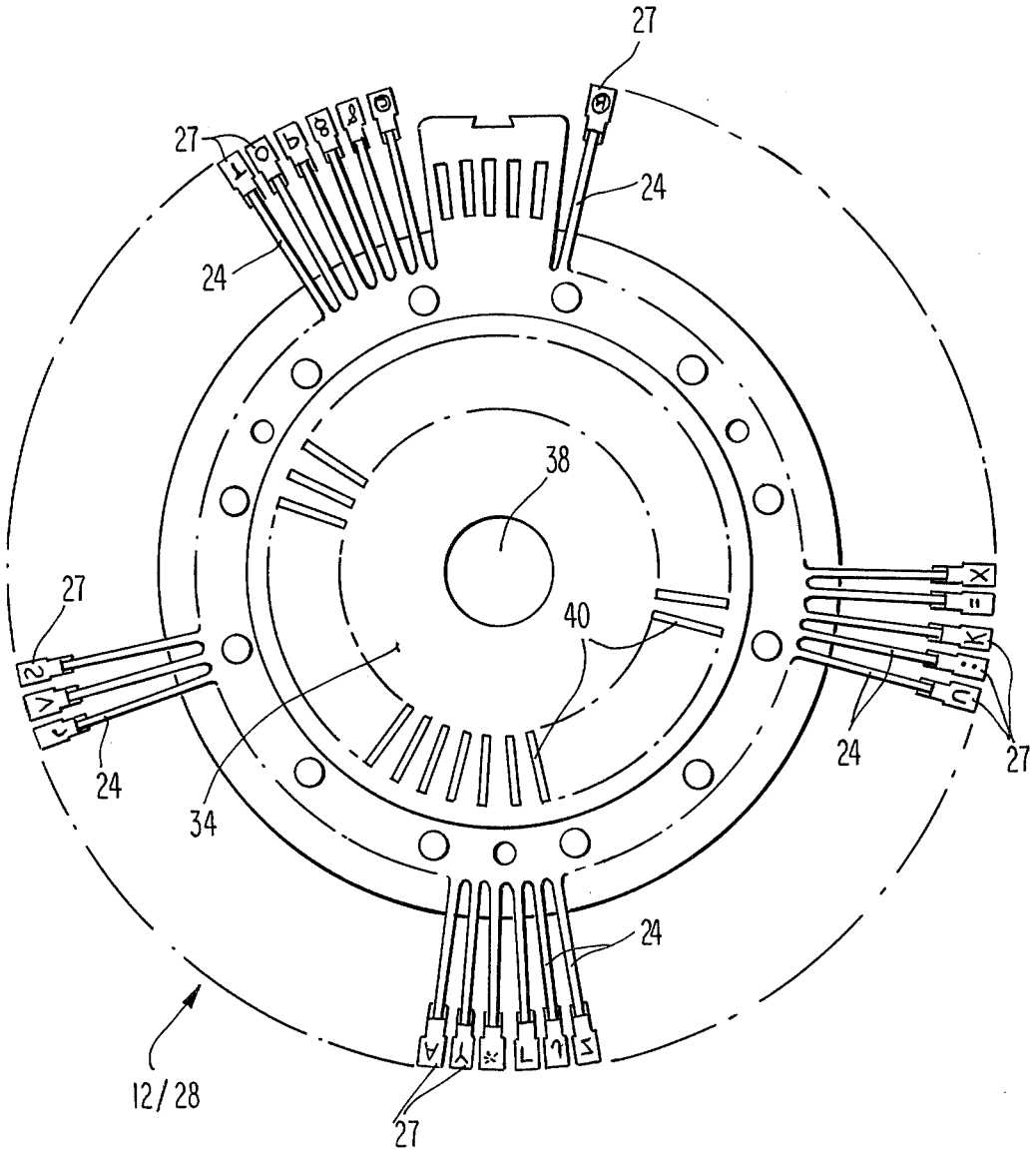
FIG. 3 is a schematic view of a circular character array which is mounted by the apparatus of the present invention.

As set forth in the aforementioned copending application Ser. No. 809,923 filed June 24, 1977 and assigned to the present assignee, which application is incorporated herein in its entirety by reference, the rotor 28 is formed as an integral structure with the character array 12. This integral character array/rotor, 12/28, may be more clearly seen in FIG. 3. There it may be seen that the array/rotor, 12/28, comprises a central hub portion 34 having a central opening 38 therein. Situated within the hub portion 34 are a plurality of radially extending rotor elements 40 and projecting from the hub portion 34 are a plurality of radially extending spokes 24 each having a character element 27 at the extremity thereof.

Figure 4:
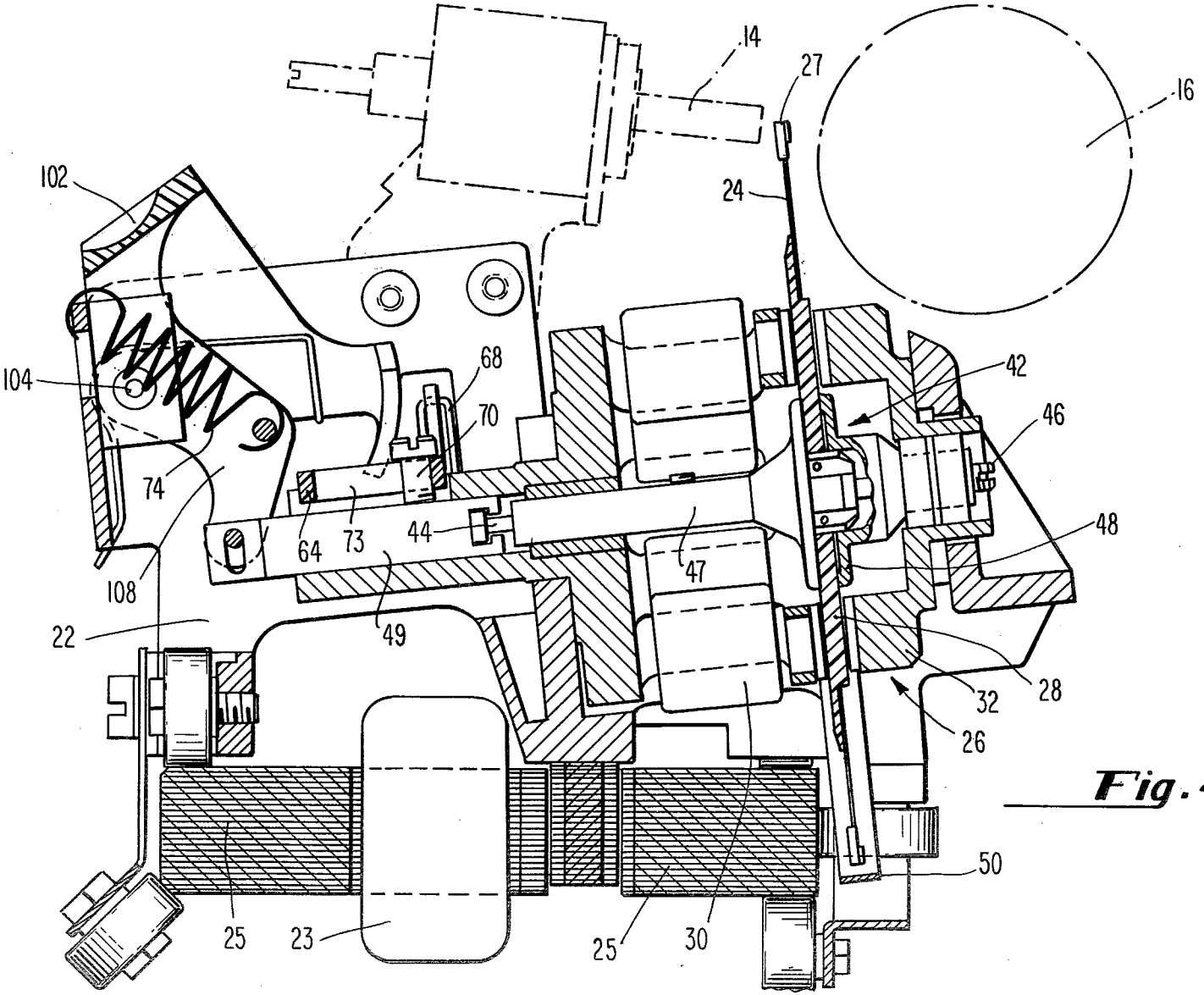
FIG. 4 is a cross-sectional view taken along line 4—4 of FIG. 2.

Referring now to FIG. 4, it will be seen that the character array 12 is mounted between the stator elements 30 and 32 on a shaft shown generally at 42. The shaft is formed of two separate parts and is thus divided into a first portion 44 and a second portion 46. The portions 44 and 46 are axially aligned with one another and are adapted to mate with one another as will be more fully explained below. The first portion 44 of the shaft 42 passes through the first excited stator segment 30 while the second shaft portion 46 passes through the unexcited stator segment 32 along the axis 36. The combination character array/rotor, 12/28, is clamped and fixed between the shaft portions 44 and 46 by a clamping means 47 which will be more fully described below.

Figure 5:
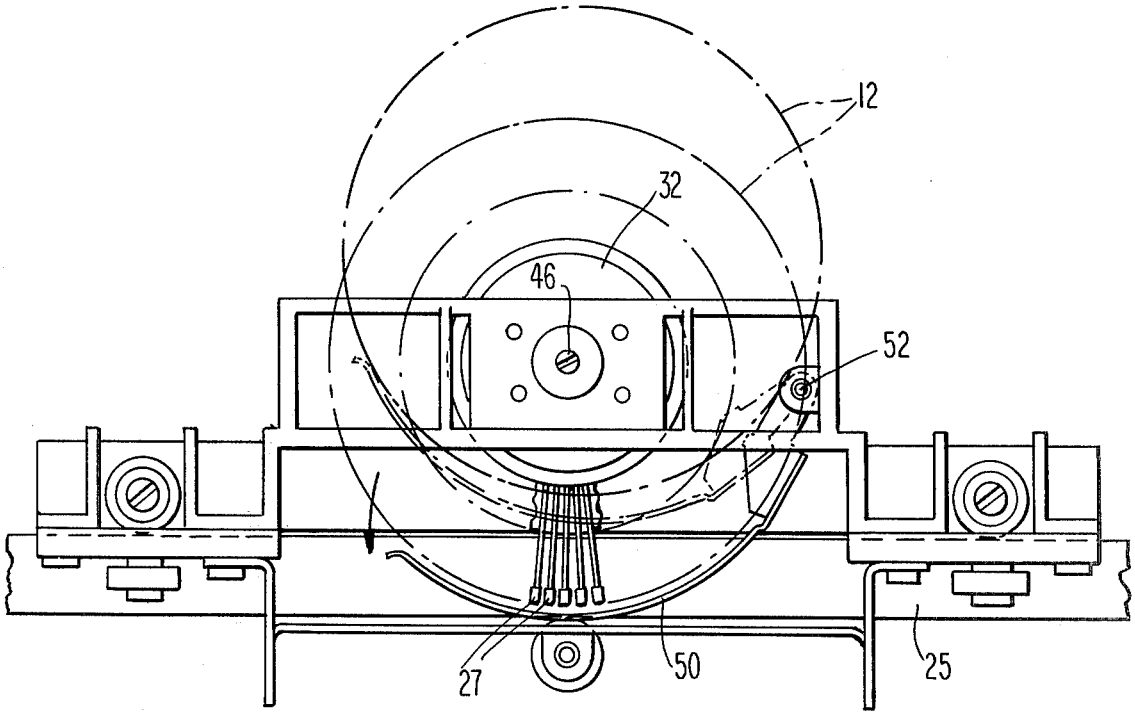
FIG. 5 is an end view of a portion of the printer shown in FIG. 3 looking in the direction of arrows 5—5 showing the various states of the mounting of a daisy type character array.

Reference will now be had to FIG. 5 wherein a very important aspect of this invention is shown schematically. FIG. 5 shows an apparatus and a method for mounting a character array 12 within the axial air gap of the motor 26 during various stages in accordance with the present invention. FIG. 5 shows a character array 12 in phantom which is supported on a moving guide means 50. In the preferred embodiment, the guide means 50 is rotatably affixed to a pivot point 52. The guide means 50 is adapted to move in an arcuate fashion as shown, although the present invention also contemplates a guide means which is adapted to move in a radial fashion. In any event, the guide means 50 is so designed such that it will reach a stop position when the central opening 38 in the hub portion of the character array 12 is accurately aligned with the axis 36 of the rotary stepper motor 26, as illustrated by the lowermost phantom view of the array 12 as shown in FIG. 5.

Figure 6:
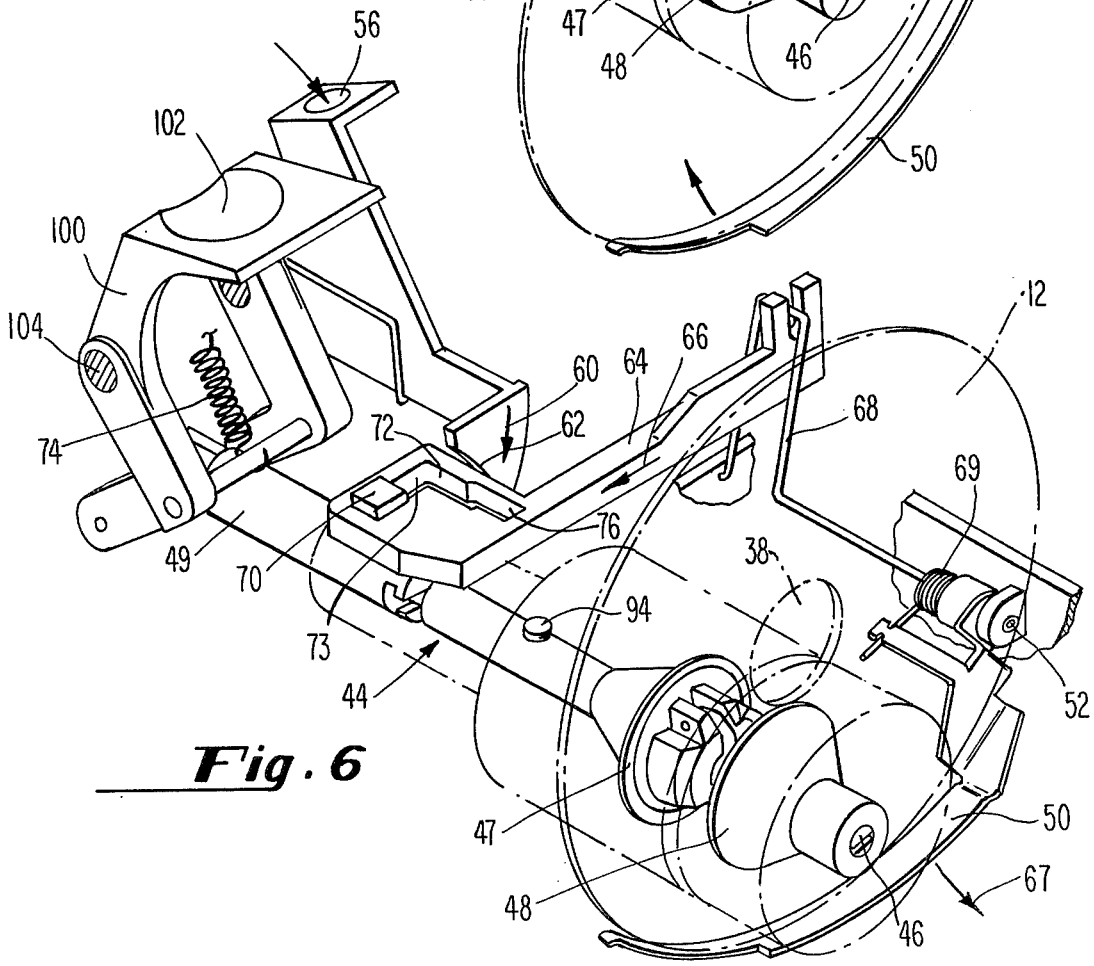
FIG. 6 is a perspective view of an assembly for locating a daisy type character element within the axial air gap of a rotary stepper motor and for confining it therein which is seen during the mounting of said daisy.

The mechanism by which the movable guide means 50 is activated will be more clearly understood by reference to FIG. 6. FIG. 6 shows a first stage in the mounting of a character array 12. Initially the two portions 44 and 46 of the shaft 42 are separated from one another and the character array 12 is placed therebetween in the axial air gap within the rotary stepper motor 26. In this position, the character array 12 is supported by the movable guide means 50. Next, a loading button 54 is depressed. The loading button 54 has a finger engageable portion 56 and the loading button pivots about an axis (not shown) which is fixedly mounted to the carriage 22. Depression of the finger engageable portion 56 of the button 54 causes the loading button to pivot in the direction of arrows 60. The lower portion of the button 54 thus depresses a first camming surface 62 which urges the linkage 64 in the direction of the arrows 66. The linkage 64, in turn, tends to rotate an arm 68 about the pivot point 52, which in turn causes the arcuate movement of the guide means 50 in the direction of arrow 67 against the tension of a spring means 69.

In accordance with an important feature of the present invention, and as will be more fully set forth below, the guide means 50 pivots until the follower 70 reaches a first lateral surface 72 of the slide 73. At this point, the movement of the guide means is momentarily retarded and the character array 12 is accurately aligned with the axis 36 of the rotary stepper motor 26.

While it is an important objective of the present invention to accurately align the character array 12, it is also an object of the present invention to securely retain the array in the proper position once it has been positioned there. Accordingly, the loading button 54 also causes the relative movement of the shaft portions 44 and 46 with respect to one another whereby the character array 12 is clamped between the clamping means 47 which rides on the first portion 44 of the shaft 42 and a mating surface 48 on the second portion 46 of the shaft 42. In a preferred embodiment of the present invention, the first portion 44 of the shaft 42 is retractable, while the second portion 46 of the shaft 42 remains stationary, however the present invention contemplates a shaft having either one or both of these portions being retractable. As shown in FIG. 6, the first portion 44 of the shaft 42 is advanced by means of a linkage 49 which is biased toward the character array 12 by a spring means 74.

The motion of the first portion 44 of the shaft 42 will be better appreciated by reference to FIGS. 7–12.

Figure 7:
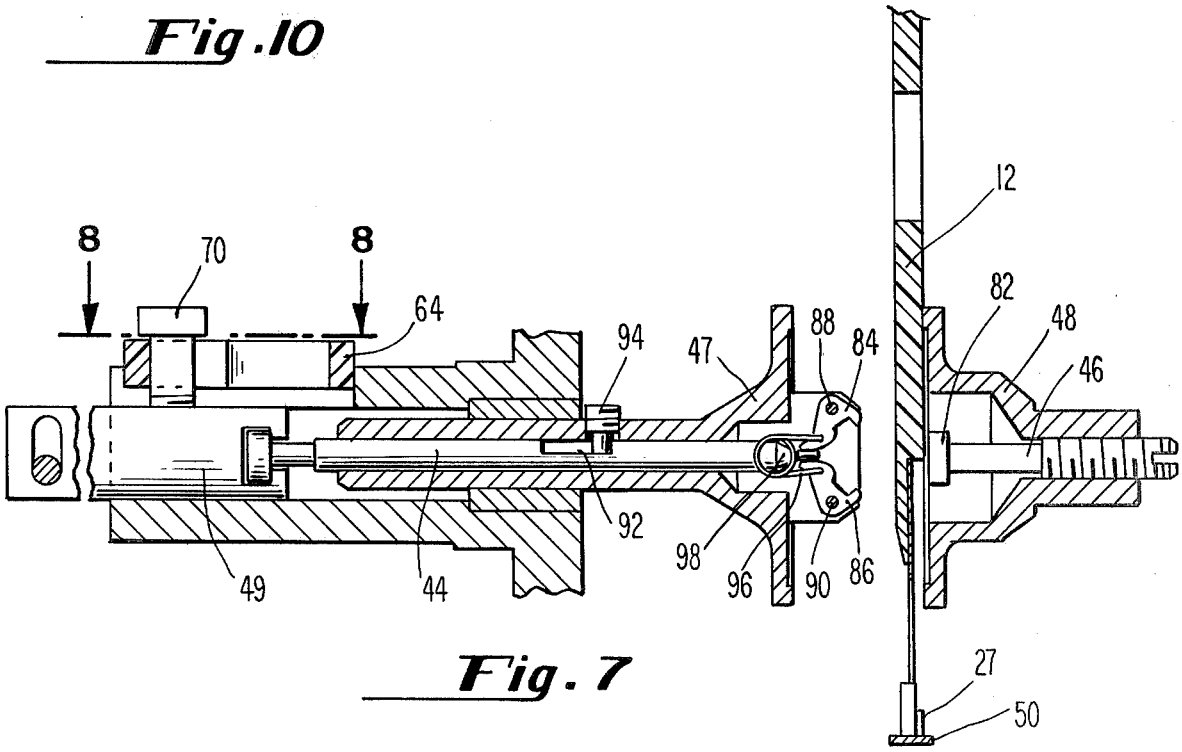
FIG. 7 is a cross-sectional view of a subassembly of the assembly shown in FIG. 6 seen during an initial stage in the loading of a daisy type character element.

Referring now to FIG. 7, the character array 12 is shown just before the first or retractable portion 44 of the shaft 42 has begun to move. At this time the follower 70, has moved from the position shown in FIG. 6 to that shown in FIG. 8. Once in this position, the spring means 74 (FIGS. 4 and 6) causes the first portion 44 of the shaft 42 to move toward the second portion 46 of the shaft 42.

Figure 9:
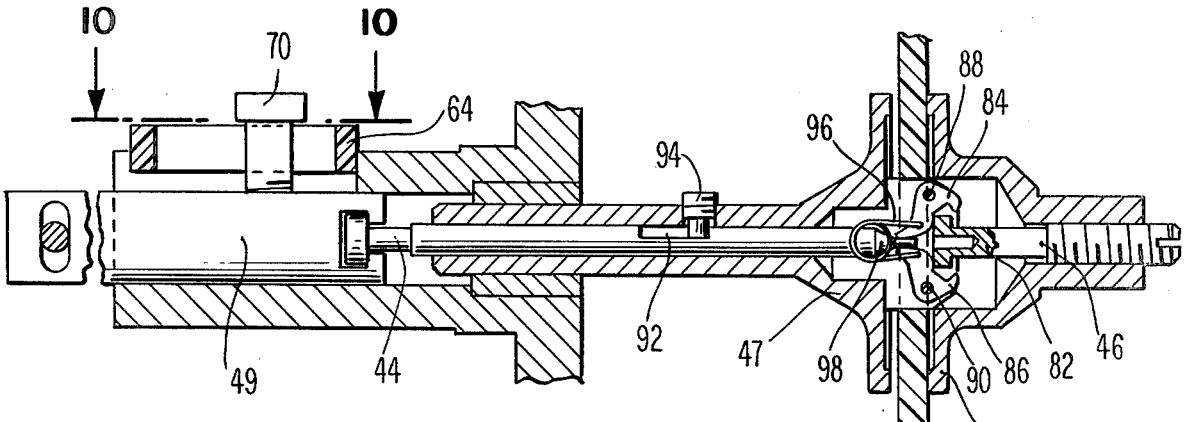
FIG. 9 is a cross-sectional view of the same subassembly shown in FIG. 7 during an intermediate stage in the mounting of a daisy type character array.
Figure 8:
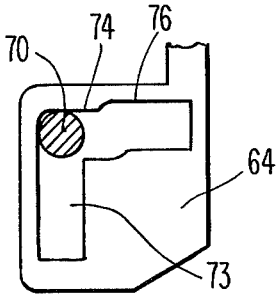
FIG. 8 is a top view of a portion of the subassembly shown in FIG. 7 looking in the direction of arrows 8—8.
Figure 10:
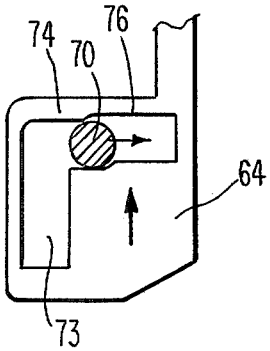
FIG. 10 is a top view of a portion of the subassembly shown in FIG. 9 looking in the direction of arrows 10—10.

The first portion 44 of the shaft 42 continues to travel toward the character array 12 until is reaches the position shown in FIG. 9. In this position, the follower 70 is free to abut a second lateral surface 76 of the slot 73 (FIG. 10). When the follower, in fact abuts the surface 76, the movable guide means 50 descends and the character array 12 is clamped in place.

Figure 12:
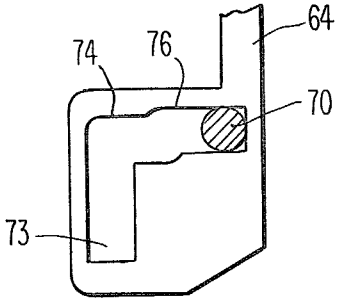
FIG. 12 is a type view of a portion of the subassembly shown in FIG. 11 looking in the direction of arrows 12—12.

Finally, and as shown in FIG. 12, the first portion 44 of the shaft 42 travels completely forward. Thus, as shown, the clamping means 47 is engaged with the character array 12 which thus grasps the array between the clamping means 47 and the mating shoulder 48. In this position, the guide means 50 does not support the array 12 thus allowing for its unimpeded rotation.

In accordance with an important embodiment of the present invention, provision is made for locking the two portions 44 and 46 of the shaft 42 to one another in order to provide for the rigidity of the shaft 42 and thus for the firm support of the character array 12. Therefore, as best shown in FIG. 12, one end of the first portion 44 of the shaft 42 is provided with a latching means 80 which is adapted to mate with a latch receiving means 82 found on the end of the second portion 46 of the shaft 42. In the preferred embodiment, the latching means 80 comprises mating claws 84 and 86 which pivot about pivot points 88 and 90. The pivot points 88 and 90 are fastened to the clamping means 47. The clamping means 47 slides on the first portion 44 of the shaft in a restricted path defined by a notch 92 and a set screw 94. Further, the latch receiving means 82 comprises an expanded portion of the shaft 42 as shown.

Figure 13:
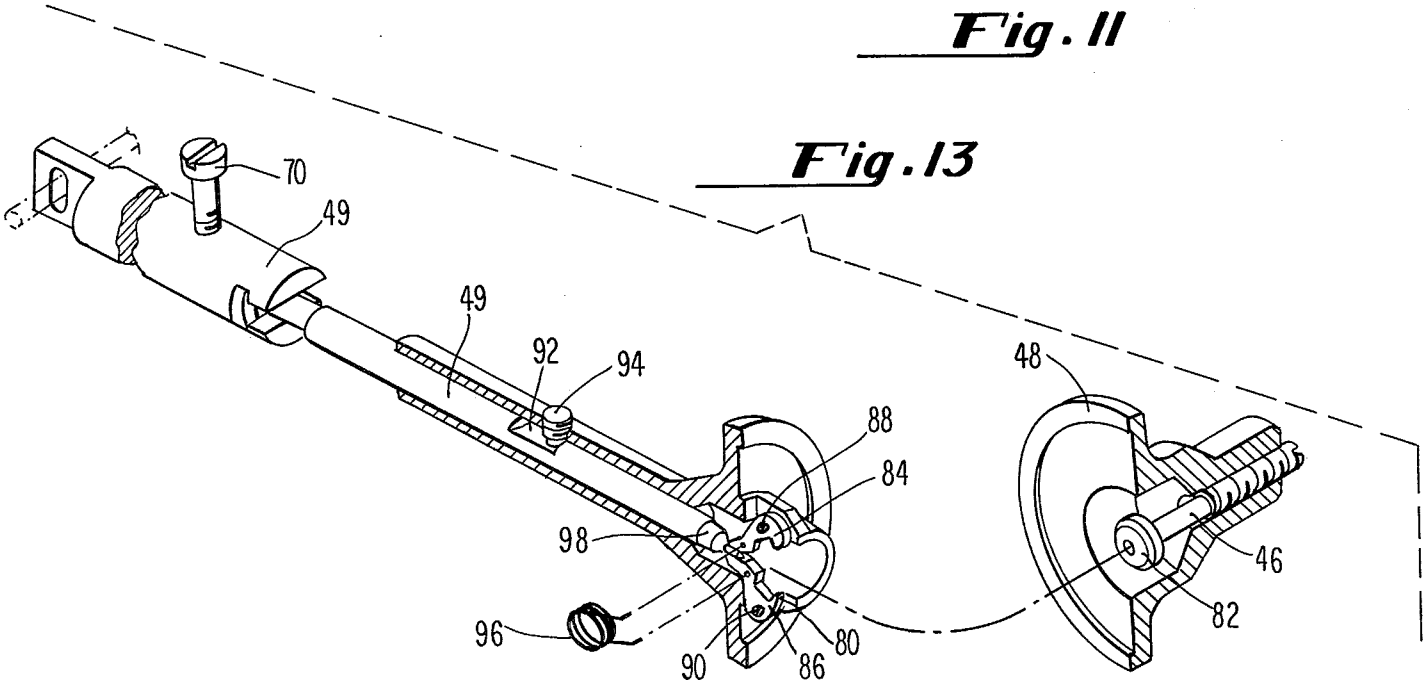
FIG. 13 is a perspective view of the subassembly shown in FIGS. 6, 8 and 10.

The first portion 44 of the shaft 42 is provided with a means for cocking the latching means 80 in an open position prior to its engagement with the latch receiving means 82. In one embodiment, the means for cocking the latching means 80 comprises a spring means 96 which tends to bias the latching means 80 in an open position such as that shown in FIG. 7. However, as may be seen from FIG. 13, a means is provided for closing the latching means 80 around a latch receiving means 82 after the array 12 has been properly positioned. Accordingly, the end of the first portion 44 of the shaft 42 is provided with a chamfered surface 98.

Figure 11:
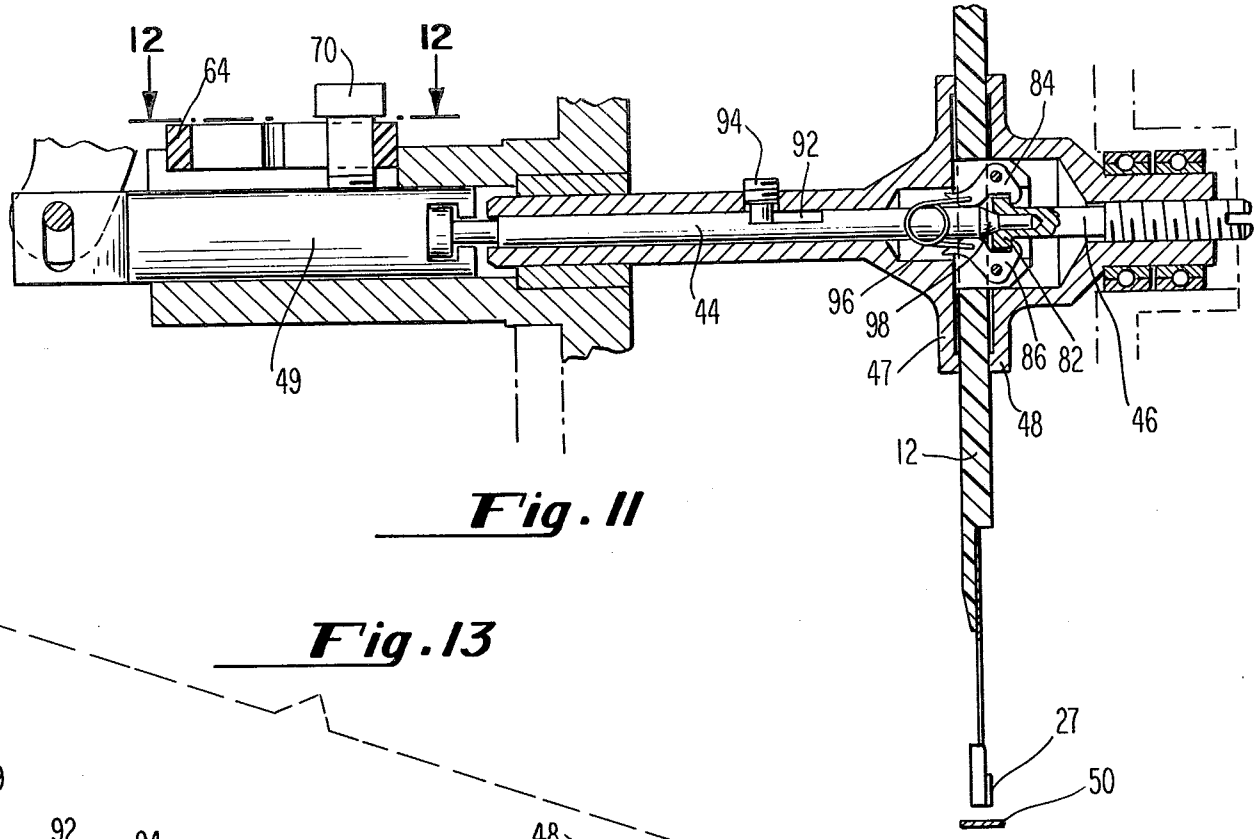
FIG. 11 is a cross-sectional view of the same subassembly shown in FIG. 7 seen during a final stage in the mounting of a daisy type character array.

As the first portion 44 of the shaft 42 moves toward the character array 12, the clamping means 47 are carried with it. After the clamping means 47 reaches the array 12, the first portion 44 of the shaft 42 continues to advance. Thus, the chamfered surface 98 passes between the claws 84 and 86 causing them to pivot and grasp the latch receiving means 82 as shown in FIG. 11.

Figure 14:
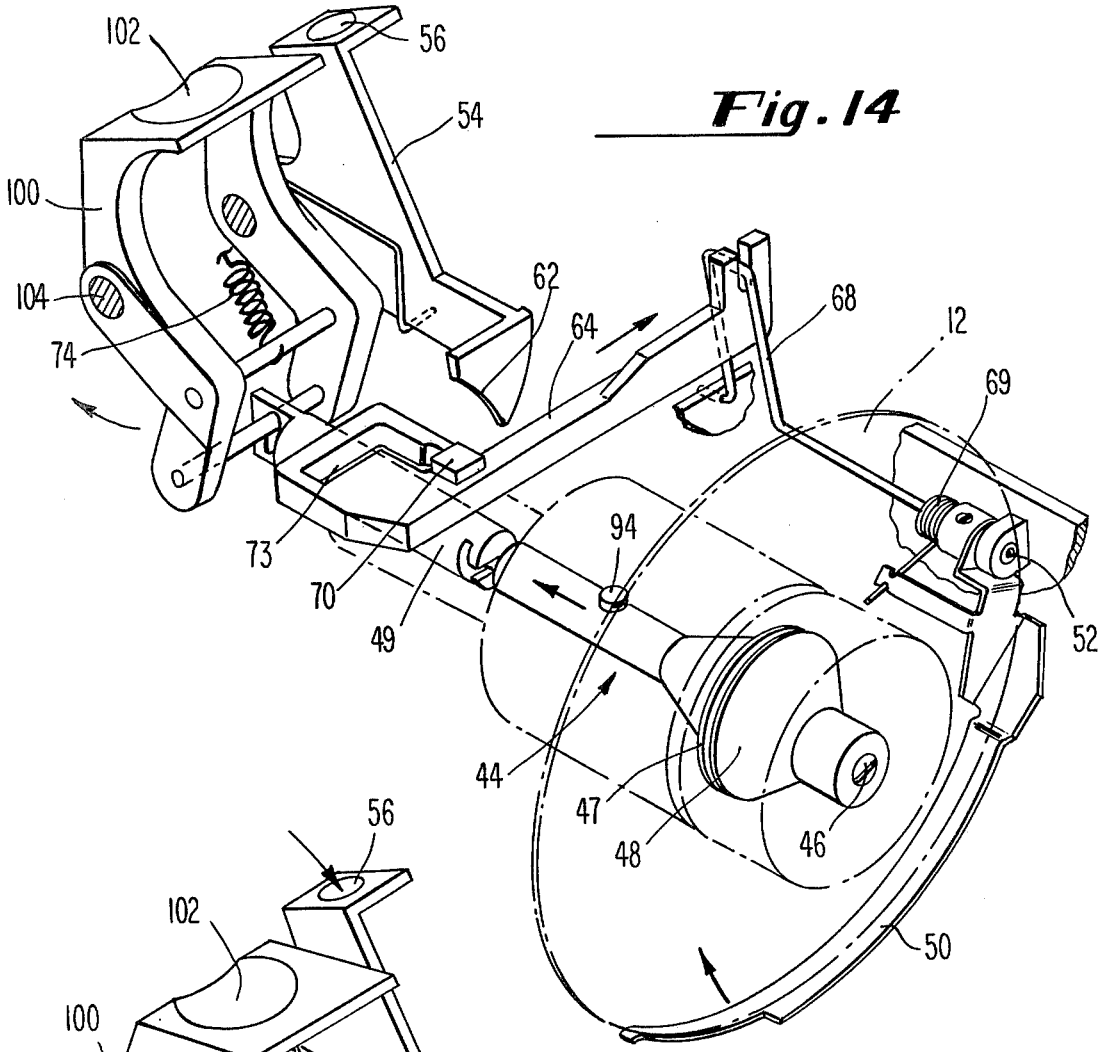
FIG. 14 is a perspective view of the assembly shown in FIG. 6 during the dismounting of a daisy type character array.

Finally, the present invention contemplates a means for removing the character array 12 from the air gap of the rotary stepper motor 26 as shown in FIG. 14. The present invention is provided with a means for disabling the latching means 80 comprising an unloading button 100. The button 100 comprises a finger engageable portion 102 and the button pivots about an axis 104. Depression of the unloading button 100 causes the first portion 44 of the shaft 42 to be retracted by a linkage 49 which allows the claws 84 and 86 to be opened by the spring means 96.

While a particular embodiment of the present invention has been shown and described, it will, of course, be understood that various modifications may be made without departing from the principle of the present invention. The appended claims, are, therefore, intended to cover any such modifications within the true spirit and scope of the invention.

What is claimed is:

1. In a printing apparatus of the type having a circular rotary character array having a hub portion, said character array being driven by a rotary stepper motor of the type having an axis and a pair of stator elements spaced apart along said axis with an axial air gap therebetween, a rotor element integrally connected to said hub portion, and a support having two axially aligned portions at least one of which is retractable with respect to the other, said support carrying a clamping means for fixing the position of said array, the improvement comprising:

a movable guide means for mating with the outermost circumference of said array to align the center of the array with said axis.

2. The apparatus of claim 1 wherein said guide means is arcuately movable.

3. The apparatus of claim 1 wherein said guide means is radially movable.

4. The apparatus of claim 1 wherein said hub portion of said array has a central opening therein and wherein at least one portion of said support is adapted to pass through said opening.

5. The apparatus of claim 4 further comprising a latching means for fastening said two portions of said support to one another through said opening.

6. The apparatus of claim 5 wherein one end of one of said support portion includes a latching means and an end of the other of said support portions comprises a latch receiving means.

7. The apparatus of claim 6 further comprising a means for disabling said latching means.

8. The apparatus of claim 7 wherein said means for disabling said latching means further comprises a means for removing said array from said air gap.

9. The apparatus of claim 8 wherein said means for removing said array comprises said guide means.

10. The apparatus of claim 1 wherein said guide means is movable downwardly to align said array.

11. In a printing apparatus of the type having a circular rotary character array having a hub portion with a central opening therein, said character array being driven by a rotary stepper motor of the type having an axis and a pair of stator elements spaced apart along said axis with an axial air gap therebetween, a rotor element integrally connected to said hub portion, and a support having two axially aligned portions at least one of which is retractable with respect to the other, said support carrying a clamping means for fixing the position of said array, the improvement comprising:

a latching means for fastening said two portions of said support to one another through said opening.

12. The apparatus of claim 10 wherein one end of one of said support portions comprises a latching means and an end of the other of said support portions comprises a latch receiving means.

13. The apparatus of claim 11 further comprising a means for disabling said latching means.

14. A method of mounting a circular character array for use in a serial impact printer to the shaft of a character array drive means, said shaft projecting toward a print receiving medium, comprising the steps of:

placing one said array on a movable guide means, whereby said array is supported at its outermost circumference by said movable guide means, said movable guide means being adapted to support a single said array;

moving said guide means to align the center of said array with said shaft;

advancing said shaft toward said array;

fastening said shaft to said character array; and removing said guide means from abutting relationship with said array.

15. In a printing apparatus of the type having a circular rotary character array having a hub portion, said character array being driven by a rotary stepper motor of the type having an axis and a pair of stator elements spaced apart along said axis with an axial air gap therebetween, a rotor element integrally connected to said hub portion, and a support carrying a clamping means for fixing the position of said array with respect to said axis, the improvement comprising:

a movable guide means for mating with the outermost circumference of said array to align the center of the array with said axis.

16. A method of mounting a circular character array for use in a serial impact printer on character array drive means, said drive means comprising a shaft and stator means and said character array comprising rotor means, comprising the steps of:

supporting said array on a movable guide means adapted to support said array at the outermost circumference of said array;

moving said guide means to align the center of said array with said shaft;

advancing said shaft toward said array;

fastening said shaft to said array; and removing said guide means from abutting relationship with said array.

* * * * *